United States Patent [19]

Sacks et al.

[11] Patent Number: 4,739,401

[45] Date of Patent: Apr. 19, 1988

[54] TARGET ACQUISITION SYSTEM AND METHOD

[75] Inventors: Jack M. Sacks, Thousand Oaks; Guy B. Coleman, Northridge, both of Calif.

[73] Assignee: Hughes Aircraft Company, Los Angeles, Calif.

[21] Appl. No.: 695,023

[22] Filed: Jan. 25, 1985

[51] Int. Cl.[4] ..... H04N 7/18; G06F 15/50

[52] U.S. Cl. ..... 358/126; 358/105; 382/1; 364/423

[58] Field of Search ..... 358/100, 103, 105, 125, 358/107–110, 126, 113; 382/1, 10, 16, 25; 364/423

[56] References Cited

U.S. PATENT DOCUMENTS

| | | | |
|---|---|---|---|
| 2,968,789 | 1/1961 | Weiss et al. | 382/25 |
| 3,579,249 | 5/1971 | Dewey et al. | 358/107 X |
| 3,641,257 | 2/1972 | Taylor | 358/105 |
| 3,924,130 | 12/1975 | Cohen et al. | 358/108 X |
| 3,988,534 | 10/1976 | Sacks . | |
| 4,096,525 | 6/1978 | Latham | 358/107 |
| 4,133,004 | 1/1979 | Fitts | 358/125 |
| 4,218,707 | 8/1980 | Reed et al. | 358/107 X |
| 4,220,967 | 9/1980 | Ichida et al. | 358/105 |
| 4,386,848 | 6/1983 | Clendenin et al. | 358/108 X |
| 4,405,940 | 9/1983 | Woolfson et al. | 358/105 X |
| 4,490,851 | 12/1984 | Gerhart et al. | 382/28 X |
| 4,603,430 | 7/1986 | Sacks | 382/41 X |

OTHER PUBLICATIONS

William K. Pratt, *Digital Image Processing*, Chapter 17, "Image Feature Extraction", 1978, pp. 471–513.

*Primary Examiner*—Stephen C. Buczinski
*Assistant Examiner*—Linda J. Wallace
*Attorney, Agent, or Firm*—Charles D. Brown; A. W. Karambelas

[57] ABSTRACT

A system (20) for identifying and tracking targets in an image scene having a highly cluttered background. An imaging sensor and processing subsystem (21) provides a video image of the image scene. A size identification subsystem (23) removes background clutter from the image by filtering the image to pass objects whose sizes are within a predetermined size range. A feature analysis subsystem (24) analyzes the features of those objects which pass through the size identification subsystem and determines if a target is present in the image scene. A gated tracking subsystem (25) and scene correlation and tracking subsystem (26) track the target objects and image scene, respectively, until a target is identified. Thereafter, the tracking subsystems lock onto the target identified by the system (20). Several methods relating to target acquisition are also disclosed.

27 Claims, 5 Drawing Sheets

TARGET ACQUISITION SYSTEM AND METHOD

BACKGROUND OF THE INVENTION

The present invention relates generally to image processing systems and methods, and more particularly to image processing systems and methods for identifying and tracking target objects located within an image scene.

One of the objectives of present day missile system design is to develop new signal processing concepts for use in the imaging seeker portion of a missile guidance system. The goal is to design an automatic target acquisition system which is capable of locating potential targets in high background clutter areas, tracking those potential targets while the missile closes, designating the most desirable target from the potential targets identified and steering the missile to the designated target.

Several problems are encountered in attempting to design such a system. One involves the need for accomplishing target acquisition and tracking in real time. The system must be flexible and sophisticated to accomplish real-time image processing. Another involves eliminating potential loss-of-lock of identified targets that may occur in high background clutter areas.

Another problem involves launch-induced transients which cause loss-of-lock of identified targets. This is caused by vibration induced by missile and seeker gimbal motion resulting in field-to-field motion in the image scene. Yet another problem is that of automatically acquiring slow-moving or stationary targets located on the ground.

SUMMARY OF THE INVENTION

Accordingly, it is an objective of the present invention to provide a target acquisition system which can identify and track targets in areas of high background clutter.

It is another objective of the present invention to provide a target acquisition system which is flexible and capable of tracking and identifying targets in real time.

Yet another objective of the present invention is to provide a target acquisition system which is relatively immune to missile motion induced scene transients.

It is also an objective of the present invention to provide a target acquisition system which is capable of identifying and tracking slowly-moving or stationary objects.

In accordance with these and other objectives of the present invention, there is provided a target acquisition system for identifying and tracking target objects located in an image scene. The target objects have known sizes and shapes. The background may be cluttered with objects of various sizes and shapes. The system may be employed on a moving vehicle, such as a missile, but it is not required that the system be in motion or that target objects be in motion.

The system includes an imaging sensor subsystem which comprises an imaging sensor and image processing electronics that provides first output signals corresponding to the image scene. A size identification subsystem is coupled to the imaging sensor subsystem which processes the first output signals in order to provide second output signals indicative of objects in the image scene whose sizes are within a predetermined size range. The size identification subsystem acts as a bandpass filter which selectively outputs image data indicative of objects whose sizes are within the predetermined size range. The size identification subsystem substantially removes background clutter from the image data being processed.

A gated tracking subsystem is coupled to the imaging sensor and size identification subsystems. The gated tracking subsystem processes the first and second output signals and tracks single or multiple target objects that are present in the image scene. The gated tracking subsystem is an "explicit" tracker, in that it tracks a target, or targets, explicitly. In particular, the gated tracking subsystem tracks points or very small areas in the image scene. Tracking location error signals related to the relative positional error of the target objects are provided as output signals from the gated tracking subsystem. In addition, information relating to those objects filtered by the size identification subsystem is provided as output therefrom.

A feature analysis subsystem is coupled to the gated tracking subsystem which processes a modified form of the second output signals to determine relative features of those objects whose sizes are within the predetermined size range. The feature analysis subsystem provides third output signals which are indicative of target objects located within the image scene having known sizes and features. The feature analysis subsystem analyzes all data available to determine the target, or targets, present in the image scene.

One embodiment of the feature analysis subsystem comprises processing circuitry which determines the relative shapes of target objects. These relative shapes are then compared to stored data corresponding to known shapes of specific target objects of interest. A target shape is identified when there is a high degree of correlation between the compared shapes. If there is a low degree of correlation, data pertaining to another target object is analyzed, and so on, until a target object of interest is found.

In a missile application, for example, since the missile can only attack one target, the most targetlike object is selected. In a cueing system application, such as may be employed in aiding aircraft pilots, or the like, numerous targets may be identified based upon a threshold level of correlation between the identified shape and the stored shapes. The decision as to which target to attack is left to the pilot.

A scene correlation and tracking subsystem is coupled to the imaging sensor, to the feature analysis subsystem and to the gated tracking subsystem for processing the output signals provided thereby. The scene correlation and tracking subsystem tracks the image scene, or an area thereof, and is employed to correct the image scene for vibrational and motion-induced apparent scene motion. The scene correlation and tracking subsystem provides guidance signals to a missile system when the target acquisition system is employed therein.

In operation, the system of the present invention automatically identifies and tracks target objects having known sizes and features, such as shape, that are located within the system's optical field of view. The imaging sensor subsystem provides digitized output signals corresponding to the image scene. The size identification subsystem processes these signals and identifies those objects in the image scene which have relative sizes that correspond to target objects of interest.

The feature analysis subsystem, and with specific reference to the shape identification embodiment, for example, then determines the shape of all objects which have the appropriate relative size. These shapes are then compared to stored shape data corresponding to target objects of interest. Those target objects whose shapes have a high degree of correlation with the stored shape data are identified as actual targets.

Since size and other relevant features are employed to identify targets, the target objects need not be moving to be located and identified. However, if the targets are moving, the combination of the gated tracking and scene correlation and tracking subsystems detects them. Consequently, the relative motion detected by the two tracking subsystems allows for motion-related aspects of the targets to be used as discriminants.

The gated tracking subsystem keeps track of the position of all target objects which have the correct relative size while the shape identification subsystem determines their relative shapes and allows a decision to be made whether or not a target object is a target of interest. The scene correlation subsystem tracks the image scene to compensate for image scene motion. The scene correlation subsystem guides the missile so as to direct it toward the target region when the system is employed in a missile guidance system.

In addition to the system outlined above, a method for use with an imaging system is also provided by the present invention. The method involves processing imaging data to identify target objects having known sizes and features located within an image scene that includes objects having various sizes and features. The first step in the method is processing the image data to identify objects in the image scene that have a size within a predetermined size range. The next step is processing the image data to analyze predetermined features of the objects that have sizes within the predetermined size range. The next step is processing the image data to identify as target objects those objects which have the requisite size and features corresponding to target objects having known sizes and features.

The method also provides for processing the image data to track the relative positions of all objects whose sizes are within the predetermined size range. The objects are tracked while the features thereof are analyzed. Under circumstances where the system is located on a moving vehicle, the method further comprises determining the relative range between the video imaging system and the target objects to assist in analyzing the predetermined features.

In a specific embodiment of the method of the present invention, the method first comprises viewing the image scene. Potential target objects are identified within the image scene whose sizes are within the predetermined size range. Then, the relative shapes of those objects whose sizes are within the predetermined size range are determined. Next, the relative shapes of those objects whose sizes are within the predetermined size range are compared to stored data corresponding to objects that have known shapes. Thereafter, these objects whose shapes substantially match any of the known shapes are selected as target objects.

BRIEF DESCRIPTION OF THE DRAWINGS

The various objects and features of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
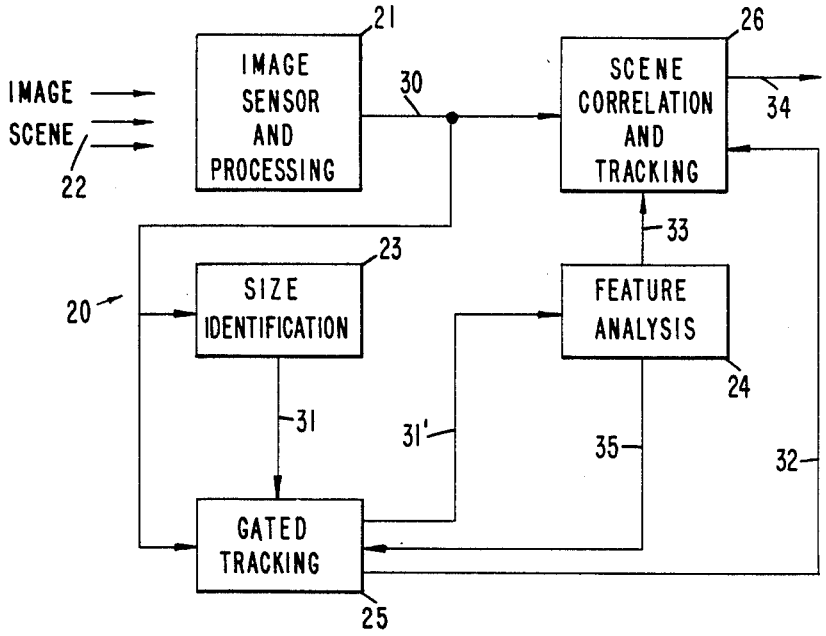
FIG. 1 shows a block diagram of the target acquisition system in accordance with the present invention.

Referring to FIG. 1, a block diagram illustrating a target acquisition system 20 in accordance with the present invention is shown. The target acquisition system 20 includes imaging sensor subsystem 21, such as a video imaging system operating in the visible or infrared spectra, or the like, or a synthetic aperture radar system, or the like, which is adapted to view an image scene 22. The imaging sensor subsystem 21 provides first output signals 30 corresponding to the image scene 22.

The imaging sensor subsystem 21 is coupled to size identification subsystem 23 which processes the first output signals 30. The size identification subsystem 23 provides second output signals 31 indicative of objects located within the image scene 22 whose sizes are within a predetermined size range. The size identification subsystem 23 "prescreens" the image data and eliminates objects from the image being processed which are not potential targets.

A gated tracking subsystem 25 is coupled to the imaging sensor 21 and size identification subsystem 23. The gated tracking subsystem 25 processes the first and second output signals 30, 31, and tracks multiple target objects that are present in the image scene 22. Tracking location error signals 32, which are indicative of the field-to-field positional error of the image scene 22, are provided as output signals therefrom. Also, the second output signals 31, as modified by gating circuitry in the gated tracking subsystem 25, are provided as output signals therefrom. These output signals are identified as second output signals 31'. The principles of operation of a gated tracker are well known and not described in detail herein.

A feature analysis subsystem 24 is coupled to the gated tracking subsystem 25 and processes the second output signals 31'. The second output signals 31 are processed by gating circuitry in the gated tracking subsystem 25 prior to their application to the feature analysis subsystem 24 as second output signal 31'. The feature analysis subsystem 24 determines the relative features of objects which are filtered by the size identification subsystem 23 and makes a determination of what targets are present in the image scene.

The feature analysis subsystem 24 compares the computed features to stored feature data related to known targets. The feature analysis subsystem 24 determines the most probable target or targets present in the image scene 22 and generates third output signals 33 which are indicative of target objects. Control signals 35 are coupled from the feature analysis subsystem 24 to the gated tracking subsystem 25 in order to control the signal flow therefrom.

A scene correlation and tracking subsystem 26 is coupled to the imaging sensor subsystem 21, feature analysis subsystem 24 and gated tracking subsystem 25 and processes the output signals provided thereby. The scene correlation and tracking subsystem 26 tracks the image scene 22 and compensates for vibration-induced motion present in the system. The scene correlation and tracking subsystem 26, when employed with a guided missile, provides guidance signals 34 as output signals therefrom.

Figure 2:
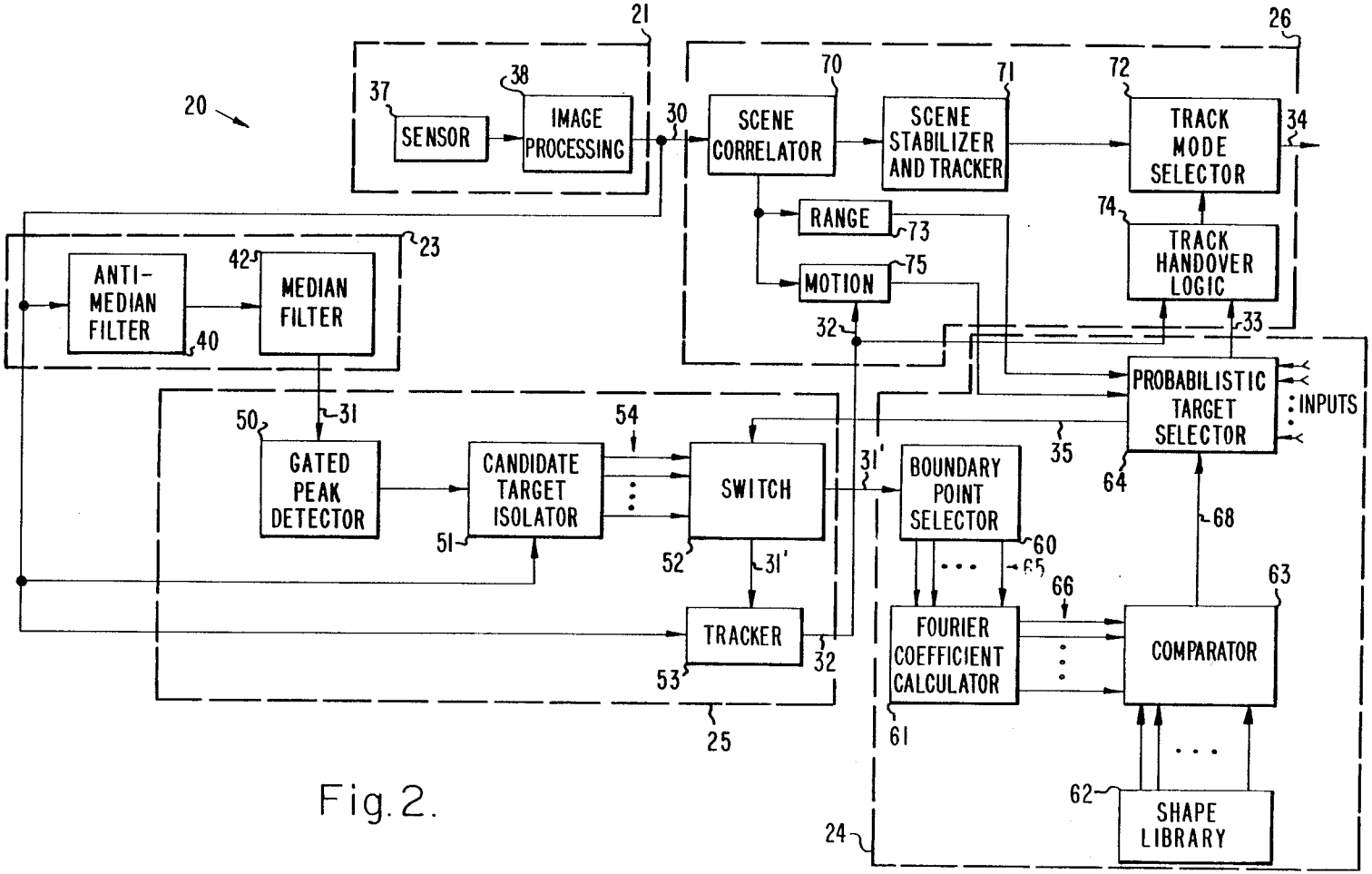
FIG. 2 shows a detailed block diagram of the system of FIG. 1.

A better understanding of the system of the present invention will be obtained with reference to FIG. 2. which shows a more detailed block diagram of the target acquisition system 20 of the present invention. As FIG. 2 illustrates, the imaging sensor subsystem 21 is comprised of an imaging sensor 37 and processing circuitry 38. Both the imaging sensor 37 and processing circuitry 38 are well-known in the art and will not be discussed in detail herein. Suffice it to say that the output signals 30 provided by the processing circuitry 38 are conventional serial or parallel video signal data compatible with the remainder of the subsystems of the system 20.

The size identification subsystem 23 is shown as a combination of median and anti-median filters 42, and 40. The anti-median filter 40 has a signal output coupled to an input to the median filter 42. The anti-median filter 40 provides output signals indicative of objects whose size are smaller than a predetermined size limit.

The median filter 42 is adapted to process the output signals from the anti-median filter 40 to generate output signals 31 which are representative of objects within the predetermined size range. The anti-median and median filter combination acts as a bandpass filter to select objects which have sizes within the predetermined size range.

This embodiment of the size identification subsystem 23 is one of many possible specific embodiments thereof. This and other pertinent embodiments of the size identification subsystem 23 are described in a presently copending patent application by J. M. Sacks, entitled "Target Size Discrimination Utilizing Median Filters," Ser. No. 653114, now U.S. Pat. No. 4,603,430, filed Sept. 21, 1984, which describes the operation of this device in detail.

The gated tracking subsystem 25 includes a gated peak detector 50 which processes output signals from the size identification subsystem 23 and identifies potential target objects in the filtered image scene based upon their relative brightness. The output of the gated peak detector 50 is coupled to a candidate target isolator 51 which processes both the first output signals 30 and output signals from the gated peak detector 50. The candidate target isolator 51 provides a plurality of parallel output signals 54 corresponding to the potential target objects and the image scene surrounding each of the objects.

Each of the parallel output signals 54 represent those objects isolated by the size identification subsystem 23 combined with a portion of the image scene surrounding each object. The gating circuitry hence provides a "window" around the candidate targets that includes the object of interest, and these signals are available for further processing. The candidate target isolator converts serial target information into parallel signals which can be processed at the discretion of the remainder of the system.

The plurality of parallel output signals 54 of the candidate target isolator 51 are coupled to a switch 52 which provides the second output signal 31' as input signals to a gated tracker 53. The second output signals 31' represent "gated" objects whose sizes are within the predetermined size range. The gated tracker 53 processes the first and second output signals 30, 31' in order to track those target objects having the appropriate size, which have been isolated by the gated peak detector 50 and candidate target isolator 51.

The gated tracker 53 provides an absolute spatial reference for use by the scene correlation subsystem 26. The gated tracker 53 provides the tracking position error signals 32 as output signals therefrom. The tracking error signals are indicative of the relative positional error of the target objects being processed during a selected time frame. In addition, the second output signals 31' are provided as output signals from the gated tracking system 25 and applied to the feature analysis subsystem 24.

Gated tracking systems are well-known in the image processing art. One possible embodiment of a gated tracking subsystem 25 is described in U.S. Pat. No. 3,988,534 issued Oct. 26, 1976 to Jacob M. Sacks titled "Electro-Optical Tracking Computer Utilizing Television Camera" and assigned to the Northrop Corporation. A gated tracking subsystem suitable for use in the present invention could be constructed by those skilled in the art with reference to the teachings of that specification.

The feature analysis subsystem 24 processes the second output signals 31' along with a variety of other signals in order to determine the presence of a target object in the image scene 22. A specific embodiment of the feature analysis subsystem 24 comprises a shape identification subsystem which determines the relative shapes of objects filtered by the size identification subsystem 23. The shape identification subsystem shown in FIG. 2 includes a candidate target boundary point selector 60 which processes the second output signals 31'. The second output signals 31' are coupled from the output of the switch 52 to an input of the boundary point selector 60. The boundary point selector 60 determines the relative distance between a target centroid and the boundary of the target. This will be described in more detail below with reference to FIGS. **4*a* and 4*b***.

A plurality of parallel output signals 65 are provided from the boundary point selector 60 which are processed by a Fourier coefficient calculator 61. The Fourier coefficient calculator 61 converts the length data determined by the boundary point selector 60 into a set of normalized coefficients representative of the shape of the potential target object. A more detailed explanation of the workings of the shape identification subsystem 24 is presented below with reference to FIGS. **4*a* and 4*b***. It is to be understood that the coefficients may be computed using other types of computational techniques, including the mean-absolute-difference algorithm.

The mean-absolute-difference correlation algorithm is similar to the Fourier coefficient algorithm in two respects. Both extract the radial distances from the object centroid to its boundary, and both then perform a normalization of the object radii. However, in the mean-absolute-difference correlation algorithm, the normalized radii are compared with stored references at several positions using absolute difference correlation.

The absolute difference correlation computes the distance from the ith reference to the object at the jth candidate position as:

$$dij = \sum_{k=j}^{\Gamma} |r_{ik} - O_k|$$

where $\Gamma = MOD_{16}(j+15)$ d designates distance r designates reference and o designates object.

The evaluation of data using this correlation algorithm does not usually have to be conducted over all 16 possible positions (spaced 22.5° apart) since targets such as tanks are not expected to be "upside down". For evaluation of scene data acquired from a low grazing angle, ±2 positions (±45°) is usually sufficient. For data gathered from a vertical look down approach, all 16 positions must be evaluated since a given object can be oriented in any angular position (rotation) with equal probability. At an intermediate acquisition angle, the number of positions that must be evaluated is a complex function of the shape of the object and of the angle of acquisition (look down angle).

The Fourier coefficient calculator 61 has a plurality of outputs 66 coupled to a comparator 63 which is adapted to compare the computed normalized coefficients to a set of stored coefficients which correspond to targets of known shape. The coefficients are stored in a shape library 62. The comparator 63 has an output 68 coupled to a probabilistic target selector 64 which processes the comparison data in order to determine the degree of correlation between the candidate target shape and the stored data. In its most basic form, if a high degree of correlation exists, a target is identified, and if a low degree of correlation exists, control signals 35 are applied to the switch 52 in the gated tracking subsystem 25 to transfer new candidate target data to the shape identification embodiment of the feature analysis subsystem 24.

The probabilistic target selector 64 is a device which, in a missile application, selects the most probable target, and in a cuing system application, for instance, selects sufficiently probable targets. The selected targets comprise candidate targets which substantially match known targets. However, since many criteria may be employed to select a specific target, including motion, or brightness, or the like, all such criteria are weighted to determine the most probable target. The selection process is quite complex and is only as good as the computer programming used to compute the probabilities and make the appropriate target selection.

The calculated Fourier coefficients from calculator 61 are typically not compared seriatim to the coefficients stored in the shape library 62. For example, the root-sum-square of the difference between coefficients may be determined. This is determined from the equation:

$$\sum_{L=1}^{N} (T_i^K - F_i^L)^2 = E_{KL}$$

where $T_i^K$ is the ith Fourier coefficient of the Kth target and $F_i^L$ is the ith Fourier coefficient of the Lth reference shape. Therefore, $E_{KL}$ is the difference between the Kth target and the Lth reference. If $E_{KL}=0$, the Kth target is exactly like the Lth reference.

A plurality of external signal inputs may be applied to the probabilistic target selector 64 in order to allow a more accurate determination of the identification of a particular target object. Such inputs as time, target velocity and target brightness are typical examples of external data which may also be processed by the probabilistic target selector 64.

In addition, the system itself may compute information relative to determining target existance. For example, target range and relative target motion may be employed to distinguish target objects from clutter and non-target objects. These inputs may be applied to the probabilistic target detector 64 in order to permit a more accurate determination of the targets present in the image scene. This will be discussed in more detail below.

The scene correlation and tracking subsystem 26 is coupled to the image processing circuitry 38, the gated tracker 53 and the probabilistic target selector 64. The scene correlation and tracking subsystem 26 includes a scene correlator 70, a range calculator 73, relative motion detector 75, scene stabilizer and tracker 71, track mode selector 72 and track handover logic 74.

The scene correlator 70 processes the first output signals 30, tracks the image scene, and provides output signals which are indicative of the frame-to-frame correlation of the imaging data. The range calculator 73 is coupled to the scene correlator 70 in order to provide range and range rate information to the probabilistic target selector 64. Also, the relative motion detector 75 is coupled to both the scene correlator 70 and tracker 53, and processes signals provided thereby in order to identify moving objects in the image scene 20. The frame-to-frame difference in the output signals provided by the correlator 70 and tracker 53 provides output signals indicative of objects which have moved since the preceeding frame.

The scene stabilizer and tracker 71 processes output singals from the scene correlator 70 to generate stabilized tracking signals indicative of a target centroid in the image scene 22. The track handover logic 74 has inputs coupled to outputs of the gated tracker 53 and probabilistic target selector 64. The track handover logic circuit 74 is a logic circuit which processes the tracking error signals 32 from the gated tracker 53 and the output signals from the probabilistic target selector 64 to generate output signals to the track mode selector 72. The track mode selector 72 processes signals from the scene stablizer and tracker 71 and track handover logic 74 to generate missile guidance signals 34 which are adapted to guide a missile towards a selected target object.

The scene correlator 70 is a device which extracts scene coordinate information by way of spatial integration techniques. The scene correlator is capable of tracking rapid real-time motions of an image scene. Therefore, vibrational and motion-induced fluctuations in the image scene from frame-to-frame are supressed by the scene correlator 70.

Scene correlation subsystems are generally well-known in the image processing art. U.S. Pat. No. 4,220,967, issued Sept. 2, 1980 to Ichida et al discloses a correlator which could be adapted for use with the present invention. Additional information on correlation trackers may be found in U.S. Pat. No. 4,133,004 titled *Video Correlation Tracker* issued Jan. 2, 1979 to J. M. Fitts.

Figure 3:
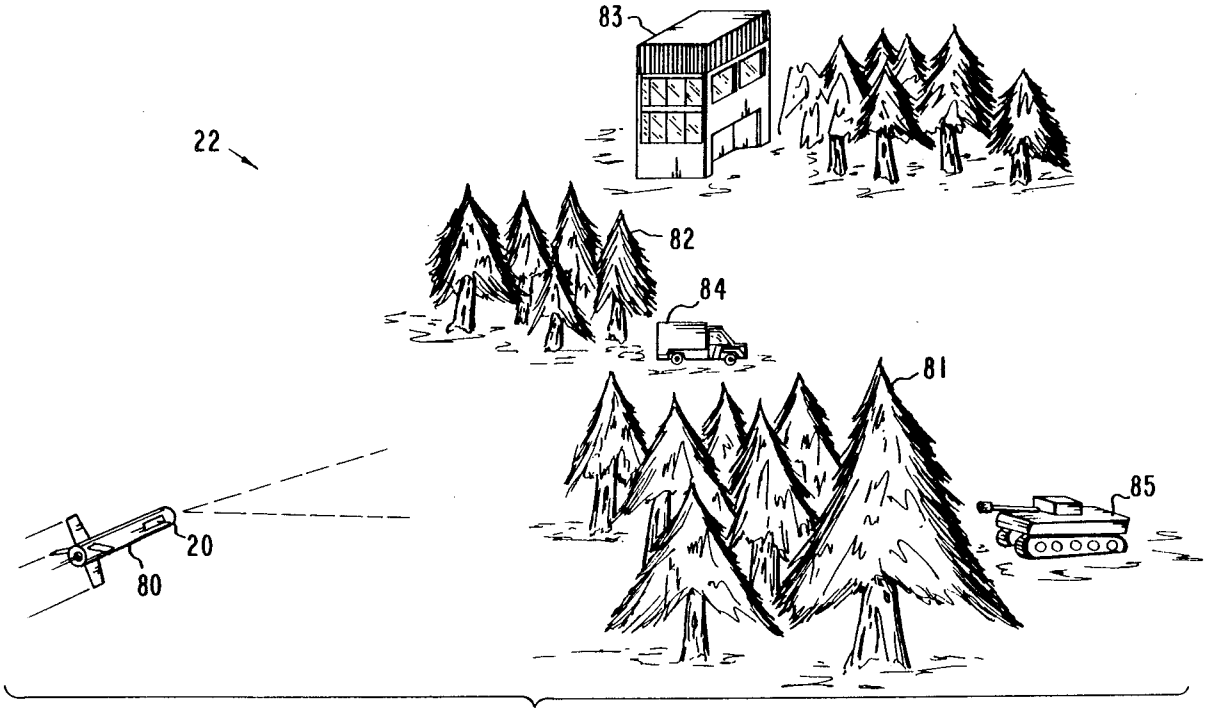
FIG. 3 shows the present invention employed in a missile system in order to illustrate the operation thereof.

The operation of the target acquisition system 20 of FIG. 2 may be better understood with reference to FIG. 3, which illustrates a typical missile deployment situation. An air-to-ground missile 80, for example, is deployed toward a target area which is viewed by the target acquisition system 20 located in the missile 80. The imaging sensor subsystem 21 provides an image of the image scene 22 which is a portion of the target area within its field of view.

Located within the image scene 22 are background objects and clutter, such as groups of trees 82 and the like. A large building 83, such as a factory, or the like, as well as vehicles, such as a large truck 84 and a tank 85 are also located in the image scene. For the purpose of example, and not by way of limitation, the imaging sensor subsystem 21 may be an infrared sensor which provides a video image related to the heat output of the objects in the field of view.

As the missile flys toward the target area from a large distance away, the scene correlation and tracking subsystem 26 tracks the target area and guides the missile 80 towards the target area. At some distance, the resolution of the imaging sensor 37 is such that it can distinguish different objects in the field of view. At this point the size identification subsystem 23 and feature analysis subsystem 24 become significant.

The size identification subsystem 23 acts as a size filter which isolates objects in the field of view that are in a predetermined size range. For example, the filter may be designed to isolate objects which are generally the size of vehicles, such as the truck 84 and tank 85. The size identification subsystem 23 allows the system to remove background clutter from the image being processed.

For example, in a missile application, or the like, where computational power and allocated space are at a premium, sophisticated processing is not usually performed on the entire image scene. Accordingly, the size identification subsystem 23 rejects objects in the image scene which cannot be target objects since they are the wrong size. The remaining scene data may then be processed more intensively.

Quite clearly, as the missile closes on the target area, the relative size of the objects in the image scene 22 changes. Accordingly, the range calculator 73 is provided to determine the range to the target area and hence provide information that can be used to obtain the actual size of objects in the field of view. Also, since motion is an important factor in determining if an object is a target, the relative motion detector 75 provides signals to the probabilistic target detector 64 for processing thereby.

The feature analysis subsystem 24, and in particular the shape identification embodiment, determines the shapes of the objects isolated by the size identification subsystem 23. The gated peak detector 50, candidate target isolator 51 and switch 52 provide information relative to the location of each of the target objects of interest in the image scene. The isolated targets are tracked by the gated tracker 53 and relative positional information is supplied to the scene correlation and tracking subsystem 26 as tracking position error signals 32. The target objects are simultaneously analyzed to determine their relative shapes.

The computed relative shape, in terms of Fourier coefficients, is compared to known target shapes stored in a computer memory of the shape library 62 in the manner as heretofore described. The shape profiles of each known target object at various aspect angles are maintained in the shape library 62. This is required since the aspect angle at which the target is viewed is constantly changing as the missile 80 closes on the target area.

It is to be understood that the analysis performed by the shape identification portion of the system 20 need not be limited to shape alone. Other types of additional feature analysis may be performed in order to identify and classify potential targets. For example, such criteria as target brightness and target edge analysis may also be employed.

The features of each target object are analyzed until it is determined whether it is a target, and this information is passed along to the probabilistic target detector 64. Targets are then identified based upon the degree of correlation of the analyzed data and the stored data, and other criteria employed in the probabilistic target detector 64. Once a target is identified, the missile 80 is steered in that direction by steering signals provided by the scene correlation and tracking subsystem 26. The features that are analyzed, and in particular the shape identification, identifies the shapes of objects whether or not they are in motion. Hence, the system is capable of identifying and tracking objects which are slowly moving or stationary.

Figure 4A:
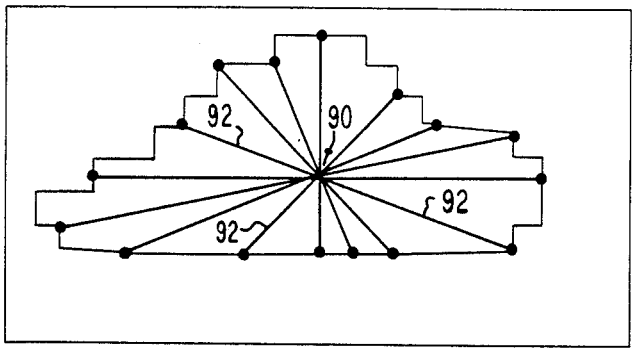
FIG. 4*a* and 4*b* illustrate the operation of the shape identification means employed in the system of FIG. 1.
Figure 4B:
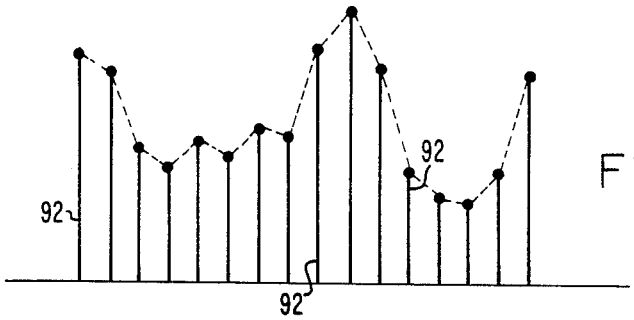

A better understanding of the shape identification embodiment of the feature analysis subsystem 24 may be obtained with reference to FIGS. 4*a* and 4*b*. FIG. 4*a* shows the operation of the boundary point selector 60. The target centroid 90 is determined from data supplied from the target isolator and switch 51, 52. From this point, a predetermined number of radii 92 are generated which intersect the target boundary. The boundary may be found using conventional edge detection schemes, such as are described in the text, Digital Image Processing by William K. Pratt, published by Wiley Interscience, see particularly Chapter 17 Image Feature Extraction, pages 471 to 513. The Text is copyright 1978.

The relative distances between the target centroid and boundary are computed for each of the radii. A discrete Fourier transform is performed on each of the radii distances to produce a set of normalized coefficients which are representative of the relative shape of the target object.

A graph of the normalized coefficients is shown in FIG. 4*b*. The vertical axis represents distance from the centroid to the boundary of the object, while the horizontal axis represents radius number. An advantage of these Fourier coefficients is that they are rotationally invariant, which is advantageous in that less processing is required to analyze target objects.

The normalized coefficients are compared to reference coefficients stored in the shape library 62 which represent known target objects. The best fit between target object coefficients and stored coefficients, computed by means of a root sum square correlation, or other similar correlation technique, determines if the target object is a known object at which to direct the missile.

Referring to FIG. 2, the probabilistic target selector 64 receives all of the information derived from the other portions of the system and evaluates it to compute the probability that each candidate target object is a true target. In the case of a missile application, the most probable target is usually selected since the missile can attack only one target. If the system is implemented as a cueing system, candidate targets having more than some minimum probability of being a true target are cued to the operator.

In order to determine the probabilities, the probabilitic target selector 64 processes a large amount of information. For example, it processes target motion generated by the relative motion detector 75 based upon signals received from the correlator 70, which measures overall scene motion, and the gated tracker 53, which measures target motion. The difference between the scene motion and target motion is the true target motion. Since all real systems must operate in the presence of noise, any measure of target motion implies a probability that the candidate is or is not moving. If there is a high probablity that the candidate target is in motion, then there is a high probability that it is not a natural clutter object, such as a bush, or a rock, or the like. In addition, other information related to the candidate target is input to the probabilistic target selector 64 including shape and brightness data, for example.

There are many methods to determine the probability that a particular candidate target is a true target. These methods comprise computer algorithms that process the input data and make the probabilistic determination. For example, target motion may be used as an initial discriminant. If the target is in motion, then its relative brightness is determined based on a predetermined threshold, for example.

Then the relative shape may be compared to known shapes in the shape library 62. If the shape matches and the candidate target is in motion, then a true target is identified with a very high probability. The other possible combinations of feature and motion aspects may be analyzed in the same way to determine the target probabilities. As may be seen, the probability may be determined based upon satisfaction of a variety of conditional probabilities or threshold criteria. Many of the techniques employed in determining probabilities are well-known in the pattern recognition art.

Clearly, there are numerous ways to determine probability and various methods may be employed in the present invention. The particular methods is typically determined by a computer programmer and the sophistication of the method is based on his skill as a programmer and the amount of data which can be analyzed to determine the probability.

It is to be understood that the scene stabilizer 71, track mode selector 72 and track handover logic 74 are normally employed only in a missile application, since it is necesary to output the guidance signals 34 to the missile. Under non-missile circumstances, target information is supplied by the probabilistic target selector 64, with the output signals 33 therefrom containing the requisite target identification information.

Figure 5:
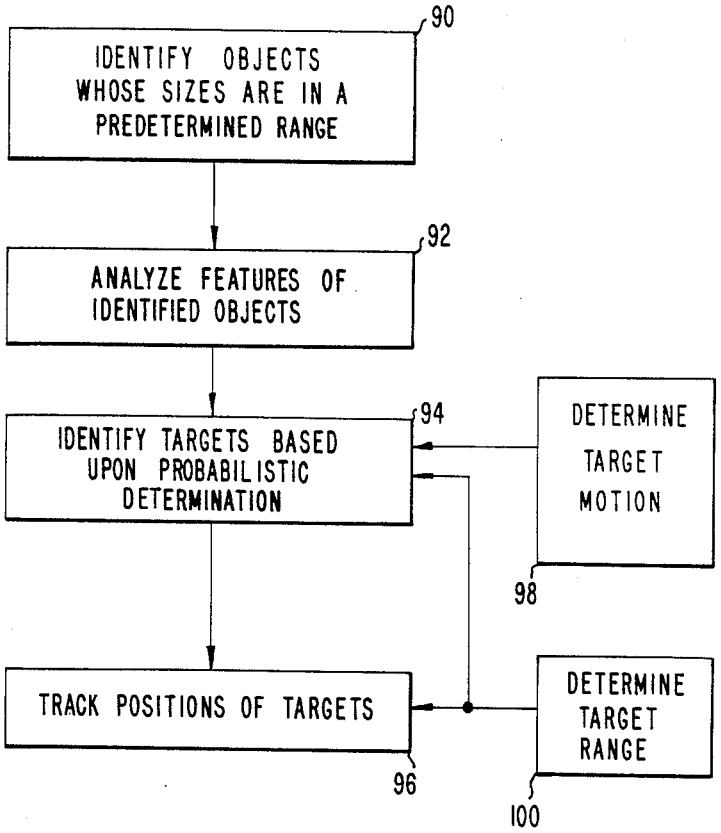
FIG. 5 is a block diagram illustrating a method of target identification in accordance with the present invention.

With reference to FIG. 5, a method for use with an imaging system is provided by the present invention. The method involves processing image data to identify target objects having known sizes and features located within an image scene that includes objects having various sizes and features. The first step in the method is processing the image data to identify objects in the image scene that have a size within a predetermined size range, as indicated in box 90.

The next step is processing the imaging data to analyze predetermined features of the objects that have sizes within the predetermined size range, as indicated in box 92. The next step is processing the image data to identify as target objects those objects which have the requisite size and features corresponding to target objects having known sizes and features based on a probabilistic computation, as indicated in box 94.

In addition, the method also provides for processing the image data to track the relative positions of all objects whose sizes are within the predetermined size range, as indicated in box 96. The objects are tracked while features and other criteria are analyzed. One aspect of the potential targets is to measure target motion, as indicated in box 98. Under circumstances where the system is located on a moving vehicle, the method further comprises determining the relative range between the video imaging system and the target objects to assist in analyzing the predetermined feature, as indicated in box 100.

Figure 6:
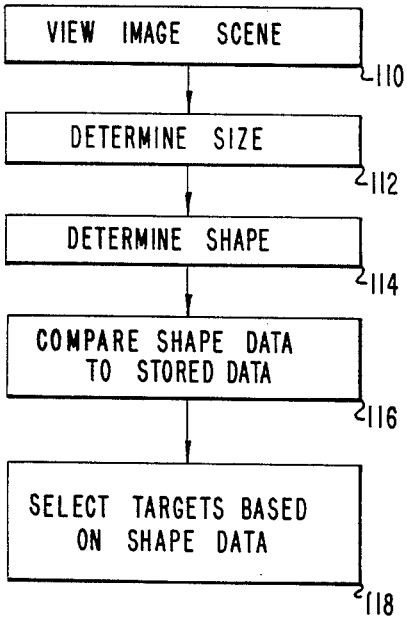
FIG. 6 is a block diagram illustrating a specific embodiment of the method of target identification in accordance with the present invention.

In a specific embodiment of the method of the present invention, and with reference to FIG. 6, the method first comprises viewing the image scene, as indicated in box 110. Potential target objects are identified within the image scene whose sizes are within the predetermined size range, as indicated in box 112. The image scene is thus pre-screened in terms of object size. Then, the relative shapes of those objects whose sizes are within the predetermined size range are determined, as indicated in box 114. Thus, the shapes of the screened objects are predetermined.

Then, the relative shapes of those objects whose sizes are within the predetermined size range are compared to stored data corresponding to objects that have known shapes, as indicated in box 116. Thereafter, those objects whose shapes substantially match the known shapes are selected as target objects, as indicated in box 118. The most target-like object is selected as the target, or all objects of some minimum level of target likeness are selected as targets, depending upon the system application.

Thus, there has been described a target acquisition system which is designed to permit identification and tracking of target objects located in an image scene viewed by the system. The present invention provides a target acquisition system which can identify and track targets in areas of high background clutter. The target acquisition system is flexible and capable of tracking and relatively immune to vibrational stimuli. The system is also capable of identifying and tracking slowly-moving or stationary objects.

A method of identifying target objects located in an image scene cluttered with background objects has also been disclosed. In addition, a method of determining the relative shapes of potential target objects located in the field-of-view of a target acquisition system has been disclosed.

It is to be understood that the above-described system embodiment and method are merely illustrative of some of the many specific system embodiments and methods which represent applications of the principles of the present invention. Clearly, numerous and varied other methods and arrangments may be readily devised by those skilled in the art without departing from the spirit and scope of the invention.

What is claimed is:

1. A target acquisition system comprising:

imaging sensor means for viewing an image scene and providing first output signals corresponding thereto;

size identification means coupled to said imaging sensor means for processing said first output signals to identify objects present in said image scene whose sizes are in a predetermined size range and for providing second output signals indicative thereof;

gated tracking means coupled to said imaging sensor and size identification means for processing said first and second output signals to track the relative positions of objects in said image scene whose sizes are within said predetermined size range and for providing tracking position error output signals corresponding thereto, and for providing gated second output signals therefrom corresponding to said objects whose sizes are within said predetermined size range;

scene correlation means coupled to said imaging sensor and gated tracking means for tracking an aimpoint contained in said image scene; and feature analysis means coupled to said gated tracking means for processing the gated second output signals to determine the features of said objects whose sizes are within said predetermined size range and for identifying target objects in said image scene based upon the features analyzed thereby.

2. The system of claim 1 wherein said feature analysis means comprises:

shape identification means for determining the relative shape of objects whose sizes are within said predetermined range.

3. The system of claim 2 wherein said shape identification means comprises:

shape computation means for providing a set of normalized coefficients representative of the shape of each of said objects whose sizes are within said predetermined size range;

shape reference means for storing sets of predetermined normalized coefficients representative of the shapes of objects of interest;

comparator means coupled to said shape reference means and said shape computation means for comparing the sets of coefficients provided by said shape computation means to sets of coefficients stored in said shape reference means and providing third output signals which are indicative of the comparison thereof.

4. The system of claim 3 wherein said feature analysis means further comprises:

probabilistic target selection means for identifying target objects located in said image scene based upon a probabilistic analysis of the features of said objects and for providing output signals therefrom.

5. The system of claim 4 wherein said scene correlation means (26) further comprises:

a scene correlator (70) coupled to said imaging sensor means for processing said first output signals to track the aimpoint of said image scene.

6. The system of claim 5 wherein said scene correlation means further comprises:

motion detection means coupled to said scene correlator means and said gated tracking means (53) for determining the relative motion of objects located in said image scene.

7. The system of claim 6 wherein said scene correlation means further comprises:

range calculation means, coupled to said scene correlator means, for determining the range to objects located in said image scene.

8. The system of claim 7 which further comprises:

a scene stabilizer and tracker (71) coupled to said scene correlator for processing output signals provided thereby and tracking said aimpoint of said image scene and for providing stabilized tracking output signals therefrom.

9. The system of claim 8 which further comprises:

a track mode selector (72) coupled to said scene stabilizer and tracker for processing said stabilized tracking output signals and providing guidance signals therefrom; and a track logic circuit (74) coupled to said gated tracking means for processing said tracking position error signals to lock onto a selected object in said image scene.

10. The system of claim 5 wherein said gated tracking means comprises:

a gated peak detector for processing said second output signals from said size identification means and providing gated second output signals indicative of selected areas of said image scene surrounding said objects having sizes which are within said predetermined size range;

candidate target isolator means coupled to said image sensor and to said gated peak detector for processing said gated second output signals and providing a plurality of parallel output signals representative of the location of each of said objects having sizes within said predetermined size range; and a gated tracker coupled to said image sensor means and said isolator means for processing said first output signals and said parallel output signals and for providing tracking position error signals, to said scene correlation means, indicative of the relative frame-to-frame positional error of said objects located in said image scene.

11. The system of claim 4 wherein said gated tracking means comprises:

a gated peak detector for processing said second output signals from said size identification means and providing gated second output signals indicative of selected areas of said image scene surrounding said objects having sizes which are within said predetermined size range;

candidate target isolator means coupled to said image sensor and to said gated peak detector for processing said gated second output signals and providing a plurality of parallel output signals representative of the location of each of said objects having sizes within said predetermined size range; and a gated tracker coupled to said image sensor means and said isolator means for processing said first output signals and said parallel output signals and for providing tracking position error signals, to said scene correlation means, indicative of the relative frame-to-frame positional error of said objects located in said image scene.

12. The system of claim 1 wherein said gated tracking means comprises:

a gated peak detector for processing said second output signals from said size identification means and providing gated second output signals indicative of selected areas of said image scene surrounding said objects having sizes which are within said predetermined size range;

candidate target isolator means coupled to said image sensor and to said gated peak detector for processing said gated second output signals and providing a plurality of parallel output signals representative of the location of each of said objects having sizes within said predetermined size range; and a gated tracker coupled to said image sensor means and said isolator means for processing said first output signals and said parallel output signals and for providing tracking position error signals, to said scene correlation means, indicative of the relative frame-to-frame positional error of said objects located in said image scene.

13. A system for identifying objects that have known sizes and features which are located in an image scene containing objects having various sizes and features, said system comprising:

imaging sensor means for providing first output signals corresponding to said image scene;

size identification means coupled to said imaging sensor means for processing said first output signals and for providing second output signals indicative of objects within said image scene whose sizes are within a predetermined size range;

gated tracking means coupled to said imaging sensor means and said size identification means for processing said first and second output signals in order to track those objects within said image scene whose sizes are within said predetermined size range and for providing tracking position error output signals indicative thereof;

feature analysis means coupled to said gated tracking means for processing said second output signals to determine the relative features of said objects whose sizes are within said predetermined size range and for providing third output signals which are indicative of target objects located within said image scene;

scene correlation and tracking means coupled to said imaging sensor means, to said feature analysis means and to said gated tracking means for processing said first and third output signals and said tracking position error signals in order to track said target objects.

14. The system of claim 13 wherein said feature analysis means comprises:

shape identification means for determining the relative shapes of objects whose sizes are within said predetermined range.

15. The system of claim 14 wherein said shape identification means comprises:

shape computation means for providing a set of normalized coefficients representative of the shape of each of said objects whose sizes are within said predetermined size range;

shape reference means for storing sets of predetermined normalized coefficients representative of the shapes of objects of interest;

comparator means coupled to said shape reference means and said shape computation means for comparing the sets of coefficients provided by said shape computation means to sets of coefficients stored in said shape reference means and providing said third output signals therefrom.

16. The system of claim 15 wherein said feature analysis means further comprises:

probabilistic target selection means for identifying target objects located in said image scene based upon a probabilistic analysis of the features of said objects and for providing said third output signals therefrom.

17. The system in one of claim 16 wherein said scene correlation and tracking means comprises:

a scene correlator coupled to said imaging sensor means for processing said first output signals to track said image scene and for providing correlated output signals representative of the frame-to-frame correlation of said image scene.

18. The system of claim 17 wherein said scene correlation and tracking means further comprises:

a scene stabilizer and tracker coupled to said scene correlator for processing said correlated output signals and tracking the aimpoint of said image scene and for providing stabilized tracking output signals therefrom.

19. The system of claim 18 wherein said scene correlation and tracking means further comprises:

a track mode selector coupled to said scene stabilizer and tracker for processing said stabilized tracking output signals and providing guidance signals therefrom; and a track logic circuit coupled to said gated tracking means and said feature analysis means for processing said tracking error signals and said third output signals to lock onto said target object.

20. The system of claim 18 wherein said gated tracking means comprises:

a gated peak detector for processing said second output signals from said size identification means and providing gated second output signals indicative of said image scene surrounding said objects having sizes which are within said predetermined size range;

candidate target isolator means coupled to said gated peak detector for processing said gated output signals and providing a plurality of parallel output signals representative of the location of each of said objects having sizes within said predetermined size range; and a gated tracker coupled to said imaging sensor means and said candidate target isolator means for processing said first output signals and said parallel output signals and providing target position error signals, to said scene correlation means, indicative of the relative frame-to-frame positional error of objects located in said image scene.

21. The system of claim 17 wherein said feature analysis means further comprises:

probabilistic target selection means for identifying target objects located in said image scene based upon a probabilistic analysis of the features of said objets and for providing said third output signals therefrom.

22. The system of claim 17 wherein said scene correlation means further comprises:

a target motion indicator coupled to said scene correlator and to said gated tracking means for determining the relative motion of target objects present in said image scene.

23. The system of claim 22 wherein said scene correlation means further comprises:

range calculation means coupled to said scene correlator for determining the range from said system to said target object.

24. The system of claim 23 wherein said gated tracking means comprises:

a gated peak detector for processing said second output signals from said size identification means and providing gated second output signals indicative of said image scene surrounding said objects having sizes which are within said predetermined size range;

candidate target isolator means coupled to said gated peak detector for processing said gated output signals and providing a plurality of parallel output signals representative of the location of each of said objects having sizes within said predetermined size range; and a gated tracker coupled to said imaging sensor means and said candidate target isolator means for processing said first output signals and said parallel output signals and providing target position error signals, to said scene correlation means, indicative of the relative frame-to-frame positional error of objects located in said image scene.

25. The system of claim 22 wherein said gated tracking means comprises:

a gated peak detector for processing said second output signals from said size identification means and providing gated second output signals indicative of said image scene surrounding said objects having sizes which are within said predetermined size range;

candidate target isolator means coupled to said gated peak detector for processing said gated output signals and providing a plurality of parallel output signals representative of the location of each of said objects having sizes within said predetermined size range; and a gated tracker coupled to said imaging sensor means and said candidate target isolator means for processing said first output signals and said parallel output signals and providing target position error signals, to said scene correlation means, indicative of the relative frame-to-frame positional error of objects located in said image scene.

26. The system of claim 17 wherein said gated tracking means comprises:

a gated peak detector for processing said second output signals from said size identification means and providing gated second output signals indicative of said image scene surrounding said objects having sizes which are within said predetermined size range;

candidate target isolator means coupled to said gated peak detector for processing said gated output signals and providing a plurality of parallel output signals representative of the location of each of said objects having sizes within said predetermined size range; and a gated tracker coupled to said imaging sensor means and said candidate target isolator means for processing said first output signals and said parallel output signals and providing target position error signals, to said scene correlation means, indicative of the relative frame-to-frame positional error of objects located in said image scene.

27. A system for identifying and tracking objects that have known sizes and shapes which are located in an image scene containing objects having various sizes and shapes, said system being adapted for use on a moving vehicle, said system comprising:

imaging sensor means for providing first output signals corresponding to said image scene;

size identification means coupled to said imaging sensor means for processing said first output signals and for providing second output signals indicative of objects within said image scene whose sizes are within a predetermined size range;

shape identification means coupled to said size identification means for processing said second output signals to determine the relative shapes of said objects whose sizes are within said predetermined size range and for providing third output signals which are indicative of target objects located within said image scene;

gated tracking means coupled to said imaging sensor means and said size identification means for processing said first and second output signals in order to track those objects within said image scene whose sizes are within said predetermined size range and for providing tracking position error output signals corresponding to the frame-to-frame motion of said objects within said image scene;

scene correlation and tracking means coupled to said imaging sensor means and said gated tracking means for processing said first and third output signals and said tracking position error signals, in order to track said target objects, said scene correlation and tracking means providing guidance signals to said moving vehicle in order to direct said vehicle towards said target object.

* * * * *